US008881895B2

(12) United States Patent
Evert

(10) Patent No.: US 8,881,895 B2
(45) Date of Patent: Nov. 11, 2014

(54) APPARATUS AND METHOD FOR DISTRIBUTING SAMPLES

(75) Inventor: John R. Evert, Fort Walton Beach, FL (US)

(73) Assignee: Samplemax, Inc., Navarre, FL (US)

( * ) Notice: Subject to any disclaimer, the term of this patent is extended or adjusted under 35 U.S.C. 154(b) by 731 days.

(21) Appl. No.: 12/847,870

(22) Filed: Jul. 30, 2010

(65) Prior Publication Data

US 2012/0024726 A1 Feb. 2, 2012

(51) Int. Cl.

| | |
|---|---|
| ***B65D 69/00*** | (2006.01) |
| ***B65D 73/00*** | (2006.01) |
| ***B42D 1/00*** | (2006.01) |
| ***B42D 3/12*** | (2006.01) |
| ***B42D 15/00*** | (2006.01) |
| ***B65D 75/28*** | (2006.01) |
| ***G09F 3/00*** | (2006.01) |
| ***G09F 5/04*** | (2006.01) |
| *A45D 40/00* | (2006.01) |
| *B42D 3/00* | (2006.01) |
| *B42D 3/04* | (2006.01) |
| *B42F 21/02* | (2006.01) |
| *B42F 21/04* | (2006.01) |

(52) U.S. Cl.

CPC ..... *B65D 73/00* (2013.01); *B42D 1/007* (2013.01); *B42D 3/12* (2013.01); *B42D 15/0086* (2013.01); *B65D 75/28* (2013.01); *G09F 3/0289* (2013.01); *G09F 5/04* (2013.01); *A45D 40/0087* (2013.01); *B42D 3/008* (2013.01); *B42D 3/04* (2013.01); *B42F 21/02* (2013.01); *B42F 21/04* (2013.01); *B42P 2221/02* (2013.01)

USPC ..... 206/232; 206/472; 283/101

(58) Field of Classification Search

USPC ..... 206/232, 223, 42, 472, 45.234; 229/92.8; 283/101

See application file for complete search history.

(56) References Cited

U.S. PATENT DOCUMENTS

| | | | |
|---|---|---|---|
| 1,903,540 | A | 4/1933 | Webster |
| 3,275,316 | A | 9/1966 | Cleary |
| 3,807,771 | A | 4/1974 | Greason |
| 4,155,454 | A | 5/1979 | Ryden |
| 4,306,737 | A | 12/1981 | Errichiello |

(Continued)

FOREIGN PATENT DOCUMENTS

| | | | |
|---|---|---|---|
| DE | 20103485 | U1 | 6/2001 |
| EP | 1078865 | A2 | 2/2001 |
| GB | 2260531 | A | 4/1993 |
| WO | 2009000031 | A1 | 12/2008 |

OTHER PUBLICATIONS

Notification of Transmittal of the International Search Report and the Written Opinion of the International Searching Authority, International Search Report and Written Opinion for PCT/US2011/045739 issued Nov. 30, 2011.

*Primary Examiner* — Anthony Stashick
*Assistant Examiner* — Raven Collins
(74) *Attorney, Agent, or Firm* — Rothwell, Figg, Ernst & Manbeck, p.c.

(57) ABSTRACT

An apparatus and method for distributing samples is provided. The distribution apparatus and method includes a sample package made up of a sample product to be distributed and a sample backing, which is attached to a sample carrier. This sample distribution method has many unique advantages, including promoting a sample product that consumers can actually, see, feel, touch, taste and smell.

19 Claims, 12 Drawing Sheets

(56) References Cited

U.S. PATENT DOCUMENTS

| | | | | |
|---|---|---|---|---|
| 4,313,557 | A | 2/1982 | Foffel | |
| 4,923,063 | A | 5/1990 | Tararuj | |
| 4,962,856 | A | 10/1990 | Carter | |
| 4,968,061 | A | 11/1990 | Bullard, Jr. | |
| 4,998,621 | A | 3/1991 | Meehan | |
| 5,004,271 | A | 4/1991 | Piatt | |
| 5,050,910 | A | 9/1991 | Schechter et al. | |
| 5,056,824 | A | 10/1991 | Olson | |
| 5,072,831 | A | 12/1991 | Parrotta et al. | |
| 5,098,127 | A | 3/1992 | Williamson et al. | |
| 5,119,952 | A | 6/1992 | Warriner | |
| 5,160,022 | A | 11/1992 | Mennella | |
| 5,197,599 | A | 3/1993 | Dolan | |
| 5,209,349 | A * | 5/1993 | Porter et al. | 206/232 |
| 5,242,521 | A | 9/1993 | Hibsch et al. | |
| 5,248,537 | A | 9/1993 | Giannavola | |
| 5,324,559 | A | 6/1994 | Brombacher | |
| 5,404,442 | A | 4/1995 | Foster et al. | |
| 5,445,821 | A | 8/1995 | Brown et al. | |
| 5,556,134 | A | 9/1996 | Barnette | |
| RE35,445 | E | 2/1997 | Pora | |
| 5,716,075 | A | 2/1998 | Evert, Jr. | |
| 5,918,908 | A | 7/1999 | Barnett et al. | |
| 5,928,748 | A | 7/1999 | Jones et al. | |
| RE36,395 | E | 11/1999 | McDonald | |
| 6,080,094 | A | 6/2000 | Dahlquist | |
| 6,155,414 | A | 12/2000 | Vaessen | |
| 6,302,388 | B1 | 10/2001 | Graushar et al. | |
| 6,326,069 | B1 | 12/2001 | Barnett et al. | |
| 6,364,097 | B1 | 4/2002 | Whitaker et al. | |
| 6,419,274 | B1 | 7/2002 | Geddes | |
| 6,435,967 | B1 | 8/2002 | Michlin | |
| 6,629,705 | B1 | 10/2003 | Ellis | |
| 6,685,226 | B2 | 2/2004 | McKinney et al. | |
| 6,749,229 | B2 | 6/2004 | Kennedy | |
| 6,773,539 | B2 | 8/2004 | Mertens et al. | |
| 6,929,128 | B2 | 8/2005 | Caldwell et al. | |
| 6,948,447 | B1 | 9/2005 | Yingling | |
| 7,007,831 | B2 | 3/2006 | Pennaneac'h et al. | |
| 7,055,861 | B1 | 6/2006 | Lee | |
| 7,063,874 | B2 | 6/2006 | Ray et al. | |
| 7,188,752 | B2 | 3/2007 | Lecoutre | |
| 7,226,628 | B2 | 6/2007 | Cai | |
| D552,172 | S | 10/2007 | Mershon | |
| 7,828,149 | B2 | 11/2010 | Kalvelage et al. | |
| 8,006,834 | B2 | 8/2011 | Marcinkowski | |
| 8,006,860 | B2 | 8/2011 | Klein | |
| 8,006,960 | B2 | 8/2011 | Okada et al. | |
| 8,425,474 | B2 | 4/2013 | Glassman et al. | |
| 2005/0048243 | A1 | 3/2005 | Brown | |
| 2005/0199516 | A1 * | 9/2005 | Laarman | 206/232 |
| 2005/0225072 | A1 | 10/2005 | Elwell | |
| 2006/0028014 | A1 | 2/2006 | McQueeny et al. | |
| 2007/0243396 | A1 | 10/2007 | Buchbinder et al. | |
| 2008/0023532 | A1 | 1/2008 | Moresi | |
| 2008/0241453 | A1 | 10/2008 | Akins et al. | |
| 2010/0163447 | A1 | 7/2010 | Greenland | |
| 2010/0230481 | A1 | 9/2010 | Emmott | |

* cited by examiner

APPARATUS AND METHOD FOR DISTRIBUTING SAMPLES

BACKGROUND OF THE INVENTION

1. Field of the Invention

This invention relates generally to the field of distributing samples of a commercial product. More particularly, the invention relates to the distribution of samples of commercial products by attaching the samples to other commercial goods, such as: magazines, books, items for sale in convenience and/or grocery stores, pharmaceutical containers (including single dose containers), etc. Additionally, the present invention relates to the packaging of individual samples, such that the samples are presented to consumers in an accessible, informative, and aesthetically pleasing manner. Additionally, the present invention relates to the attachment of page marking devices, including but not limited to plastic adhesive flags, to publications and/or commercial articles.

2. Background of the Invention and Prior Art

It is a well known marketing strategy of manufacturers to distribute free samples of their goods in order to entice consumers to make future purchases. Benjamin T. Babbitt, a $19^{th}$ century businessman, is recognized as being one of the first people known to have advertised through the use of free samples. Specifically, Benjamin T. Babbitt distributed free samples of soap. However, the use of free samples is pervasive in today's economy, and is no longer limited to the soap industry of Benjamin T. Babbitt.

Free samples are a commonplace in today's advertising and marketing campaigns. Free samples of a wide variety of goods are constantly being dangled in carrot like fashion in front of hungry consumers. The goods available as free samples are a diverse group ranging from individual commercial items (e.g., perfumes and pharmaceuticals) to services (e.g., gym or discount buying club memberships). However, all free samples, no matter what good or service is being "pushed," suffer from an identical same problem, distribution. That is, unless the free sample is actually presented to and received by a consumer it cannot have the desired effect of enticing future sales. Put simply, a free sample that is sitting in a box has no market effect, whereas a free sample in a consumers hand has the potential for market effect.

A common example of an industry that uses free samples in advertising is that of men's and women's fragrances. Fragrance free samples are distributed using a variety of methods. Department stores often stock free samples of fragrances that are distributed to consumers in the store. Often these samples are distributed in one of two ways. First, free samples are distributed by a store clerk that offers to provide a sample either on a sample card or on the actual person of a consumer. Second, free samples are distributed during checkout where free samples may be included in the shopping bag of the consumer. Both of these methods suffer from many drawbacks.

The first method often is viewed negatively by consumers as an annoyance, and thus may actually harm the product placement more than it helps. The second method is not effective for a variety of reasons, including: the store clerk forgets to include the sample in the consumer's shopping bag, or conversely includes so many samples that no one particular product is highlighted. Given the numerous drawbacks of distributing fragrance free samples in person, some of which have been highlighted above, manufacturers and marketers have turned to other modes of distributing free samples of their products.

One mode of free sample distribution embraced by the fragrance industry is the use of magazines as a distribution tool. For example, magazines often include samples of fragrances in the form of folded magazine scent strips that when unfolded exposes a strip containing a microencapsulated fragrance slurry. The exposed microencapsulated fragrance slurry, while not an actual sample of a fragrance, allows the reader to smell the fragrance. U.S. Pat. No. 5,248,537 is directed to one embodiment of the fold-type magazine page for distributing fragrances, as described above. However, this method of free sample distribution suffers from numerous shortcomings.

A shortcoming of the fold-type magazine free sample, described above, is the placement of the free sample inside of the magazine and out of eyesight of potential consumers of the magazine (and fragrance). That is, a potential consumer of the magazine would not be able to see the advertisement and free sample without first opening (and likely buying) the magazine. Moreover, where the free sample is desirable and could be a positive selling point for the magazine, the internal fold-type magazine free sample fails to provide additional incentive to purchase one magazine over another.

A shortcoming of the fold-type magazine free sample, described above, is that most magazines have numerous pages of advertising, included in which are often a large number of fold-type magazine free samples. Thus, by placing the free sample as a page of a magazine, the manufacturer runs a significant risk of the free sample simply being overlooked and/or lost among the numerous other advertisements and free samples included in the magazine. This problem is similar to the department store clerk including too numerous a number of free samples in the shopping bag of consumer.

Another shortcoming of the fold-type magazine free sample, described above, is the lack of usability of the free sample. That is, the paper strip samples cannot be utilized in the same manner that a consumer would expect to use the advertised product if it were purchased. For example, a fragrance strip in a magazine might be rubbed on a potential consumer's skin to transfer a small amount of the fragrance, but this is not the way that fragrances are generally applied. Thus, a free sample of fragrance distributed in this manner cannot be utilized by a consumer over a period of time in order to help persuade the consumer to purchase the product. Additionally, a consumer might be skeptical that the actual product would be fairly represented in this form.

Another shortcoming of the fold-type magazine free sample, described above, is the inability to separate the free sample from the magazine without damaging the publication. That is, if a consumer would like to, for whatever reason, separate the scented strip from the magazine, it is necessary to tear or cut the free sample from the publication. This damage has many negative effects. For example, it lessens the consumer's ability to use the magazine by destroying content contained on the reverse side of the page containing the free sample. Generally, the front and back of fold-type magazine advertisements are used to advertise the same product. However, if the opposite side of the fold-type magazine advertisement was used as additional advertising space by the magazine, this additional advertising space would be negatively impacted by the removal of the fold-type advertisement. Thus, advertisers and marketers would likely be inclined to pay less for advertising space that is on the reverse side on a fold-type magazine free sample.

Another mode of free sample distribution by magazine is the inclusion of three-dimensional free samples, i.e., free samples that are of a shape that would prevent a magazine from lying flat when closed if the free sample were included inside of the magazine. These free samples are most often included (1) in the magazine's shrink-wrapping or (2) attached to the magazine cover or magazine pages. However, both of these methods have significant weaknesses.

One weakness of including a three-dimensional free sample in either of these ways stems directly from the shape and proportions of the free sample packaging. Specifically, if the free sample packaging covers a small portion of the magazine cover or page and is not relatively thin in comparison to the magazine cover or page, the free sample packaging is likely to cause damage to the magazine and/or other magazines during shipping and distribution of the publication. For example, if a small plastic tube containing a free sample of perfume was attached to a magazine page, the earlier pages of the magazine would have to bulge and disfigure to accommodate the shape of the free sample packaging.

U.S. Pat. No. 4,968,061 is specifically directed to this problem and provides a solution by cutting slots through multiple pages in a magazine that provide enough space for the free sample while at the same time allowing the magazine to lay flat when closed. However, this solution is unacceptable because it inherently reduces the value of advertisements placed on the pages found earlier in the magazine in many ways, such as: reducing the advertising space on the earlier pages, and possibly "cross contaminating" advertisements on earlier pages that when viewed by a consumer also reveals the three-dimensional free sample. For example, if Ralph Lauren is advertising a new fragrance, they would likely be less then pleased if a consumer viewing their print advertisement could also see a free sample of a Calvin Klein fragrance at the same time. Thus, the invention of U.S. Pat. No. 4,968,061 has significant problems.

Another problem associated with three-dimensional free samples included in the magazine's shrink-wrapping or attached to the magazine cover or magazine pages is that it creates a pressure point that may damage the free sample. For example, a free sample of perfume (in the form of a small plastic tube) attached to a page of a magazine creates a pressure point that is stressed when the magazine is stacked. This pressure point increases the likelihood that the free sample of perfume will be damaged and its contents spilled into the magazine, thus damaging the magazine and the free sample beyond use. Again this problem can be addressed by the invention of U.S. Pat. No. 4,968,061, but that method has significant drawbacks, as discussed above.

Additionally, advertisers and marketers have placed free samples on the covers of magazines, or simply included free samples within the shrink-wrapping of a magazine. For example, compact discs containing software are often shrink-wrapped with computer related magazines. This type of free sample distribution is positive in that it acts as an enticement to a potential consumer of the magazine. However, this placement of a free sample still results in the in the problem of bulging. This bulging problem does not affect the individual magazine including the free sample, but rather other magazines shipped and distributed with the magazine. That is, if a number of magazines are stacked and each of the magazines includes a three-dimensional free sample attached to the cover, then the only magazine not affected by the bulging is the magazine on the very bottom of the stack. Likewise, the magazine most likely affected most by the bulging is the uppermost magazine of the stack. This magazine is subjected to a bulge equal to the collective bulge of each individual magazine's three-dimensional free sample. For example, if ten magazines are stacked and each magazine has a 0.5 inch free sample attached to the cover, then the top most magazine is subjected to a 4.5 inch bulge while the bottom most magazine is not subjected to any bulge. This bulging would likely warp and damage the magazines during transit. Additionally, the pressure would likely damage or destroy the free samples attached to the covers of the magazines. In cases where the free samples are liquids, the damaging of these samples would likely cause collateral damage to the magazines themselves. Additionally, the bulging would decrease the number of magazines that can fit into fixed space magazine racks, such as checkout counter magazine racks.

Additionally, by placing free samples on the covers of magazines, the thickness of the overall magazine is increased. This is a drawback because the amount of shelf/rack space that is available for any given magazine is finite, and by increasing the overall thickness of the magazine the number of magazines that can fit into the finite space is reduced. Additionally, free samples placed on the front or back covers of magazines necessarily obscures the front and back cover of the magazine, including the magazines cover art/copy. The cover art of a magazine may entice a consumer to buy the magazine, and thus obscuring the cover art could easily be viewed as a negative by magazine publishers. Additionally, if the free samples are included with the magazines using shrink wrap, the magazine is unreadable at a magazine store or grocery checkout because the magazine cannot be opened.

Co-owned U.S. Pat. No. 5,716,075 is directed to a binding product holder in the form of a transparent plastic tube that is capped and attached to the spine of a publication. The invention of this patent, while solving many of the shortcomings discussed above, is not appropriate for all forms of sample distribution. For example, a publication with the attached product holder of U.S. Pat. No. 5,716,075 will not fit in many publication displays (e.g., grocery store checkout lane wire racks). Additionally, because many publications are very thin, the relatively bulky product holder of U.S. Pat. No. 5,716,075 will not attach correctly to the publication.

Therefore, there remains a need for effective methods, systems, and apparatuses for the distribution of product samples. In particular, there is a need for advancements in the distribution of samples attached to publications.

SUMMARY OF THE INVENTION

According to an embodiment of the present invention, an apparatus is provided for distributing samples. The apparatus includes a sample package made up of a sample product to be distributed and a sample backing. The apparatus further includes a sample carrier. The sample package and the sample carrier are joined.

According to another embodiment of the present invention, a method for distributing page flags is provided. The method includes attaching a page flag dispenser to a carrier. The carrier can either be a publication or a consumer article.

According to another embodiment of the present invention, a method for distributing samples is provided. The method includes forming a sample package made up of a sample product to be distributed and a sample backing. The method further includes joining the sample package to a sample carrier.

The embodiments of the present invention yield several desirable advantages over the prior art, including:

- providing new product introductions where maximum visibility is required;
- promoting a product that consumers can actually, see, feel, touch, taste and smell;

allowing the promoter of the sample to have the highest visibility of their product being displayed (i.e., allowing the sample to be seen without having to open the publication);

enabling publications/consumer articles to have a new and highly profitable space to sell advertising;

providing a highly visible point-of-purchase location for the sample product being displayed;

providing a positive impact impression from association of both publisher/consumer product and sample advertiser (e.g., a Gucci sample advertisement displayed on the spine of a highly respected magazine, such as, Vogue magazine);

providing additional space for an instantly redeemable coupon that can influence consumer buying decisions;

providing additional space for additional information, such as: expanded content booklets, mail-in rebates, product information, cross-promotional literature, and/or multilingual translations of product information;

promoting brand awareness more effectively;

reducing the space and manpower required to distribute product samples;

generating sales based on the inclusion of a free sample of a desirable product;

allowing for the use of three-dimensional sample advertisements;

increasing the distribution of samples to a target audience;

providing permanent advertising space beneath the sample;

allowing consumers to sample actual products, rather than approximations of the products;

allowing consumers to use the sample in a manner more akin to actual use of a product (e.g., spraying a fragrance on via a sample tube rather than rubbing a page of a magazine on one's skin);

providing an inexpensive attachment mechanism for the sample package;

providing opportunities for new or smaller companies that do not own shelf space to distribute samples;

providing advertisement space without interfering with ad space on the front or rear covers of publications;

providing a sample distribution mechanism that can be used with any size publication;

providing a sample distribution mechanism that can be used with dust jackets.

Further applications and advantages of various embodiments of the present invention are discussed below with reference to the drawing figures.

DETAILED DESCRIPTION OF THE PREFERRED EMBODIMENTS

The present invention, including but not limited to the embodiments described herein, relate to the distribution of samples using sample carriers (i.e., publications and/or other consumer articles). Publications, include, but are not limited to, magazines, books (including hardbacks, paperbacks, dust jackets, etc.), pamphlets, booklets, flyers, and other such printed materials. Consumer articles refer to goods which are sold or distributed and are not grouped under publications. That is, embodiments of the present invention could be applicable to any product that is sold. Examples of consumer articles include, but are not limited to, vitamins, cosmetics, medication bottles, three-ring binders, household cleaners, etc. Additionally, the present invention relates to the attachment of page marking devices, including but not limited to plastic adhesive flags, to publications and/or commercial articles, such as three-ring binders.

Examples of liquid samples include, but are not limited to, fragrances, cosmetics, food items, etc. Examples of solid samples include, but are not limited to, cosmetics, electronics parts, pharmaceuticals, unit dose samples, seed packets, computer components, flash drives, food items, etc.

For example, according to the present invention, small quantities of fragrances may be distributed in blister packets (i.e., blister packages), plastic containers, vials, and/or sachets. Additionally, according to embodiments of the present invention, free samples may also be distributed in plastic skin packaging, plastic pouches, paper pouches, spray bottles, tubes, packets, foil pouches, etc. This list in no way limits the scope of the invention.

Figure 7A:
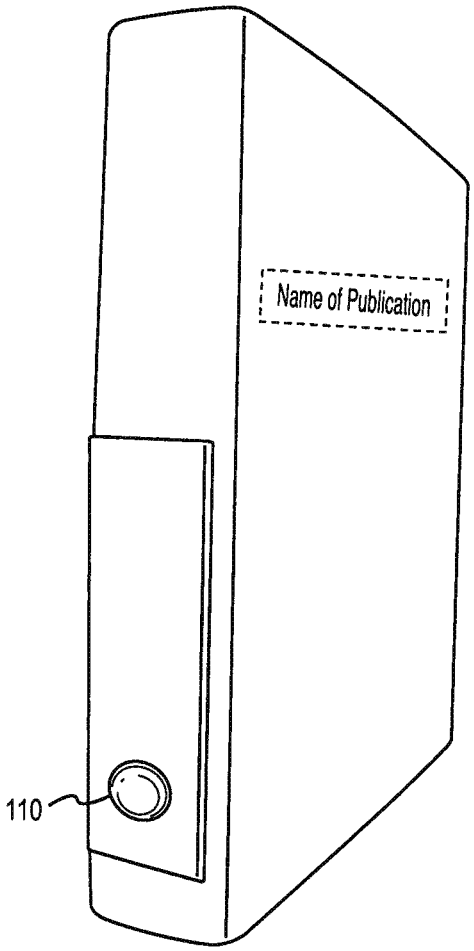
FIGS. 7*a*-7*c* are illustrations of sample packages attached to dust jackets.

According to other embodiments miniature replicas of full size products can be distributed. For example, according to an embodiment of the present invention and as illustrated in FIG. 7*c*, a miniature hot sauce bottle containing a liquid sample of hot sauce could be attached to a cookbook (or the dust cover of a cook book) for distribution.

Figure 1B:
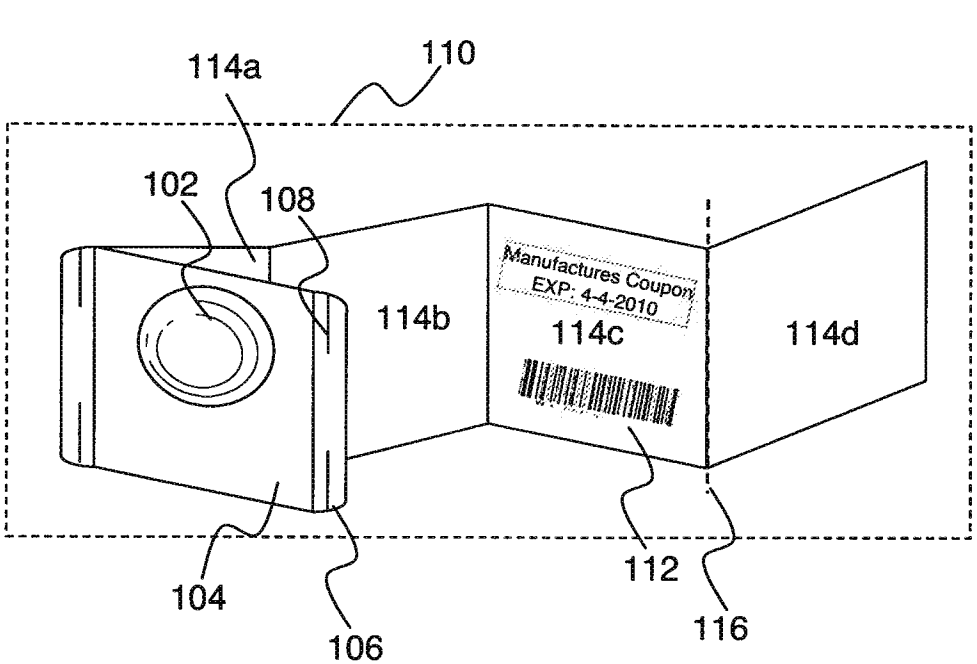
FIGS. 1*a*-1*d* are illustrations of sample packages.
Figure 1A:
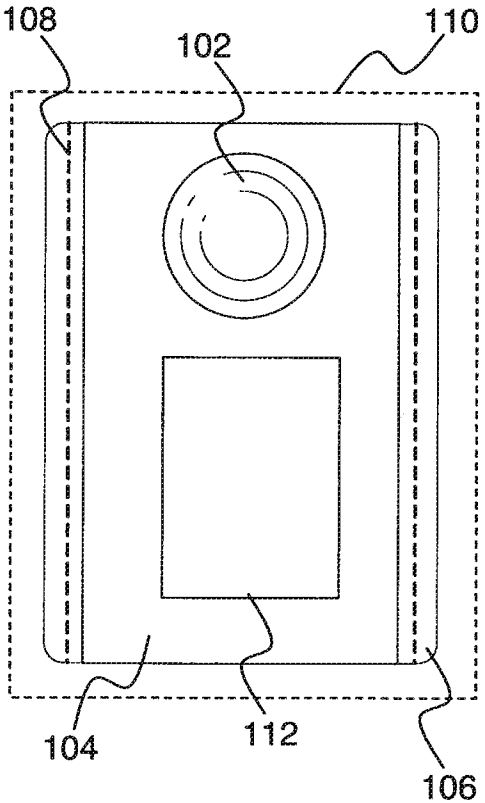

According to one embodiment of the present invention, as illustrated in FIG. 1*a*, a product sample may be distributed by attaching a sample 102 to a sample backing 104 in order to form a sample package 110, which can then be attached to a publication or consumer article. Sample 102 can be a liquid, solid, or a mixture of liquids and solids. Sample backing 104 can be made of a variety of substances, including, but not limited to: paper, plastic, or metal. Additionally, sample backing 104 could be a pressure sensitive label.

Sample 102 is a container for a product sample to be distributed. Sample 102 is, according to one embodiment, a container for a liquid, including, but not limited to: a blister pack, pouch, vile, tube, or any other leak resistant container. According to another embodiment, sample 102 is a container for one or more solids, including, but not limited to: a blister pack, pouch, vile, tube, bag (resealable and non-resealable), net, plastic skin packaging, or any other container capable of housing the product sample.

Sample backing 104, according to one embodiment, is a flat card onto which sample 102 is attached. According to another embodiment of the present invention, the sample backing 104 comprises two or more layers, such that a portion of sample 102 is visible and/or passes through the front most layer(s) of the sample backing 104 and is sandwiched between two or more layers of the sample backing 104.

According to embodiments of the present invention, sample 102 can be attached to sample backing 104 in a variety of ways, including, but not limited to: adhesive tape, glue, staples, and pressure (in embodiments where sample 102 is sandwiched between two or more layers of the sample backing 104). According to different embodiments of the present invention, glues and/or adhesives that are used to connect sample 102 to sample backing 104 are of varying strengths and permanency.

For example, according to one embodiment, permanent glue is used to attach sample 102 to sample backing 104, thus the sample 102 cannot be removed from the sample backing 104. This could be desirable to advertisers who, for example, do not want their branding/marketing materials to be separated from a blister pack of a fragrance. That is, advertisers may want their message (which can be printed on sample backing 104) to be viewed each and every time sample 102 is used. According to another embodiment, removable glue is used to attach sample 102 to sample backing 104, thus the sample 102 can be removed from the sample backing 104. This could be desirable to advertisers who, for example, want potential consumers to use their product in a fashion that requires both the use of the sample 102 and the sample backing 104. For example, a spice company could distribute a spice sample with a recipe that is printed in/on the sample backing 104. In this case, the advertiser could desire that the recipe be separated from the sample 102 for ease of use in the kitchen.

Additionally, according to one embodiment of the present invention, the sample backing has an inherent value that is separate and distinct from the sample 102. For example, the recipe, as discussed above, retains its value long after the spice sample is consumed. Thus, it is contemplated that an ancillary benefit of the present invention is that consumers could retain the sample backing 104 independent from the sample 102, thereby creating a secondary opportunity for marketing and advertising.

The sample package 110 can include glue or adhesive for attaching the sample package 110 to a publication or consumer article. For example, as shown in FIG. 1*a*, sample package 110 includes adhesive strips 106 that are attached to the sample backing 104 and can be attached a publication or consumer article. According to one embodiment of the present invention the adhesive strips are printed with advertising material. According to one embodiment of the present invention, adhesive strip 106 is scored with separation line 108 that allows the sample backing 104 (to which sample 102 is attached) to be removed from the publication without having to remove the adhesive strips 106 from the publication. The removability of the sample 102 and sample backing 104, according to one embodiment of the present invention, is necessary to allow the use of the sampled product. Additionally, the use of separation lines 108 in removing the sample 102 and sample backing 104 from the publication or consumer article, has the distinct advantages of both preventing damage caused to the publication or consumer article during removal of the adhesive strips 106 and ease of use for the consumer. In alternative embodiments of the present invention, the separation lines 108 do not score the entire length of the adhesive strips 106, but rather are notches on the top and bottom that allow a consumer to tear adhesive strips 106 from top to bottom cleanly.

According to one embodiment of the present invention, as shown in FIG. 1*a*, the sample backing 104 includes an individualized content area 112. The individualized content area 112 can be a location to print content that changes more frequently than the content printed on sample backing 104. For example, content that could be printed on individualized content area 112, includes, but is not limited to: coupons (including instantly redeemable coupons), recipes, special offers, updated product information, product description, product trademark, pictures, lenticular printing, raised inks, embossed copy, domed print, etc. Print copy can also be placed under the sample package 110 such that after removal of sample package 110 product information or copy is present on the publication binding spine or consumer article for additional and permanent advertising. Later readers would still have the opportunity to be impacted by the advertising that was related to the sample.

FIG. 1*b* is an illustration of a sample package 110, according to another embodiment of the present invention. In this embodiment, the sample package 110 includes a sample 102 and a sample backing 104 that is multi-layered and includes a folded booklet, e.g., a straight folded booklet, booklet label, or expanded content label, (pages 114*a*-114*d*). According to one embodiment, these booklets can contain instant redeem coupons, mail-in rebates, comprehensive product information, cross-promotional literature and multi-lingual translations. In one embodiment, sample 102 protrudes through a die cut hole within sample backing 104. In one embodiment of the present invention, the pages 114*a*-114*d* of the folded booklet contains individualized content areas 112. As shown in FIG. 1*b*, the individualized content area 112 on page 114*c* contains a manufacturer's coupon. According to one embodiment of the present invention, pages 114*a*-114*d* of the folded booklet are separated by scored folds 116 to better allow consumers to remove portions of the sample backing 104, e.g., coupons. Additionally, as described above, separation lines 108 on the adhesive strips 106 are notches on the top and bottom of adhesive strips 106 that allow a consumer to tear adhesive strips 106 from top to bottom cleanly.

Figure 1D:
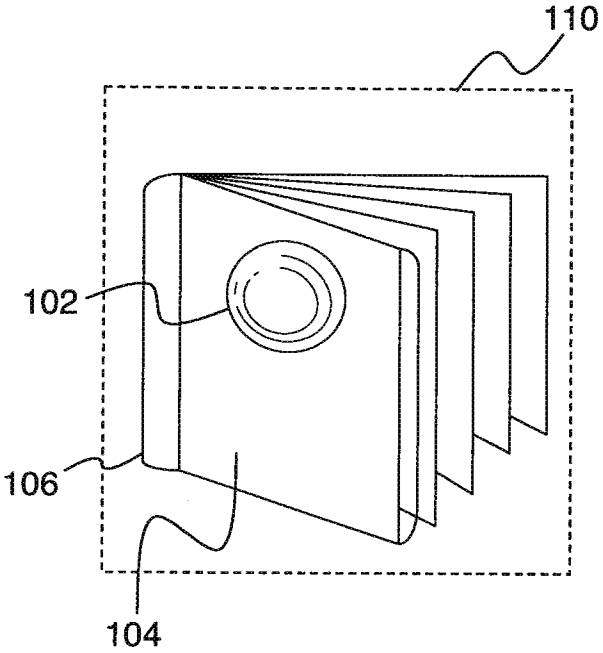
Figure 1C:
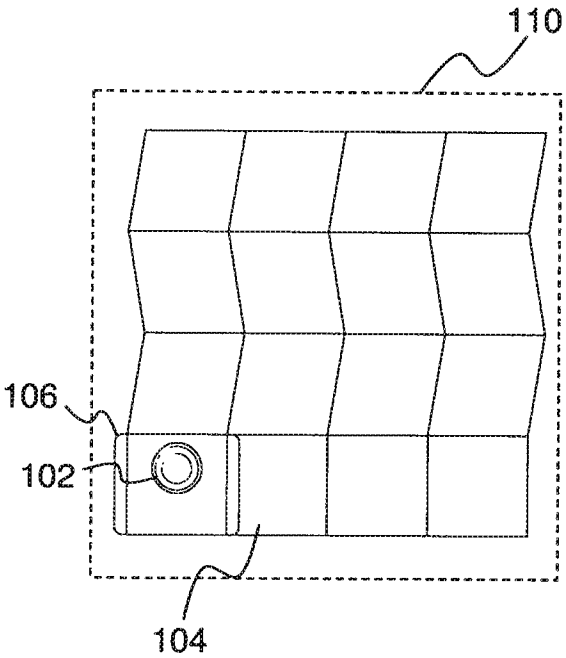

According to the present invention, FIGS. 1*c* and 1*d* are alternative embodiments of sample package 110. FIG. 1*c* illustrates that the sample backing 104 is a folded booklet, e.g., a map folded booklet. FIG. 1*d* illustrates that the sample backing 104 is a conventional booklet, e.g., bound style booklet, that is bound on one edge. While not explicitly shown, FIGS. 1*c* and 1*d* may contain sample package 110 features described above with regard to FIGS. 1*a* and 1*b*. The afore described booklets are often referred to in the industry as booklet labels and/or expanded content labels (ECLs).

Figure 2:
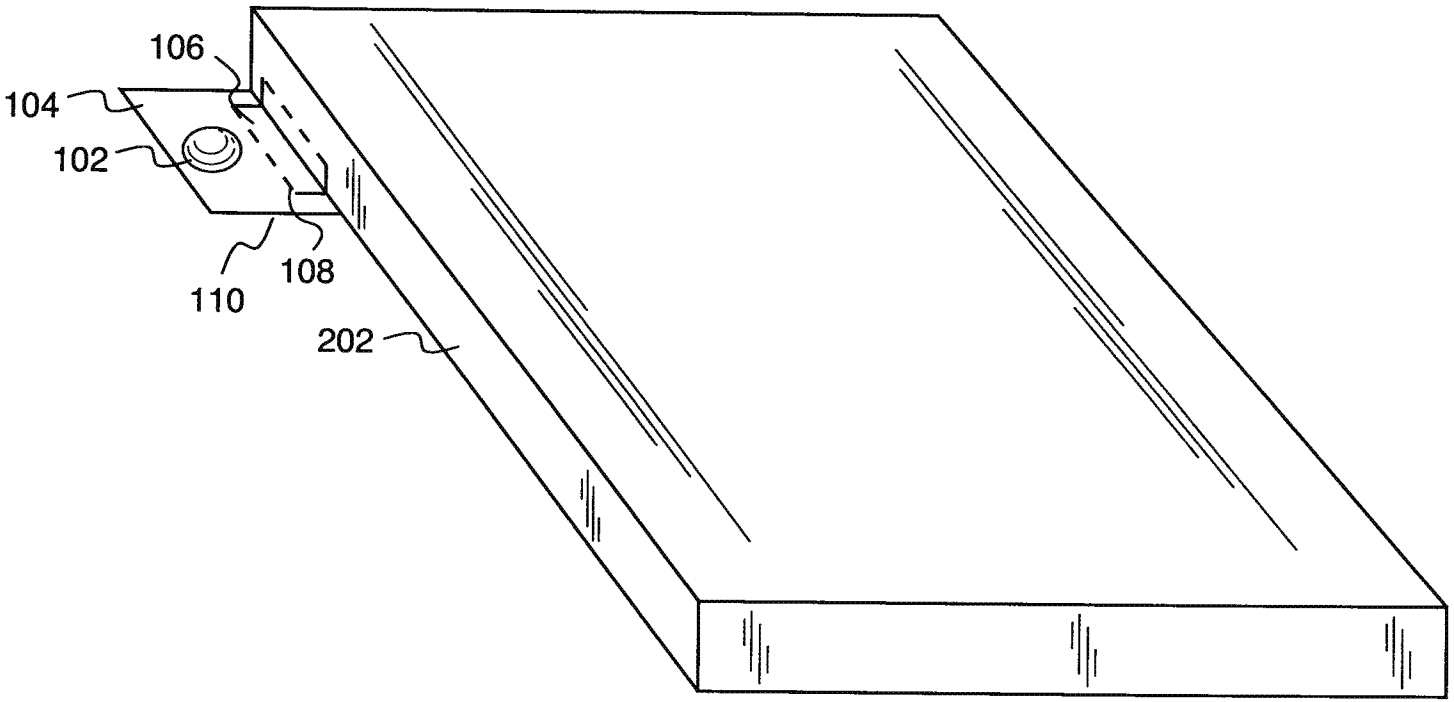
FIG. 2 is an illustration of a sample package attached to a publication.

FIG. 2 illustrates one embodiment of the present invention. According to the illustrated embodiment, a sample 102 and sample backing 104 are attached to form a sample package 110. According to one embodiment of the present invention, sample package 110 is attached to the perfect bound or saddle-stitched binding spine of publication 202 utilizing two adhesive strips 106. In other embodiments of the present invention, the sample package 110 is attached to publication 202 utilizing one adhesive strip 106. Additionally, in other embodiments of the present invention, the sample package 110 is attached to the perfect, stapled, sewn, or saddle-stitched binding spine of publication 202 utilizing glue and/or staples. A sewn publication is constructed in the same way as a hardbound publication, except that it lacks the hard covers. The binding is as durable as that of a hardbound publication. Saddle-stitching is accomplished by stapling a publication through the centerfold, thereby joining a set of nested folios into a single publication. For example, most comic books are saddle-stitched. In order to prevent the sample package 110 from affecting the stacking of multiple copies of publication 202, it is necessary that the sample package 110 be no thicker than the thickness of publication 202.

The adhesive strip 106 extending from the front of the sample package 110 to the front of the publication 202 is shown in FIG. 2. A second adhesive strip 106, not shown in FIG. 2, extends from the back of the sample package 110 to the back cover of the publication 202. Thus, the sample package 110 is attached to the publication 202 such that the sample backing 104 is substantially in the same plane as the back cover of publication 202, and the sample package 110 extends horizontally from the back cover of the publication 202. According to one embodiment of the present invention, sample package 110, as shown in FIG. 2, contains some or all of the features described above in reference to FIGS. 1*a*-1*d*. Additionally, while the sample package 110 is attached to publication 202 via adhesive strips 106, it is contemplated that glue (permanent or removable) could be used in place of or to supplement adhesive strips 106. In another embodiment, sample backing 104 overlaps the publication 202 back cover with adhesive 106 attaching sample backing 104 in the overlap area.

In another embodiment of the present invention, sample package 110 is attached to publication 202 utilizing one adhesive strip 106 in a sample package 110 and publication back cover overlap area. The adhesive strip 106 extending from the right front side of the sample package 110 to the backside of the publication 202 in an overlapping fashion. Thus, the sample package 110 is attached to the publication 202 such that the sample backing 104 is substantially in the same plane as the back cover of publication 202, and the sample package 110 extends horizontally in an overlapping fashion from the back cover of the publication 202. According to one embodiment of the present invention, sample package 110, as shown in FIG. 2, contains some or all of the features described above in reference to FIGS. 1*a*-1*d*. Additionally, while the sample package 110 is attached to publication 202 via adhesive strip 106, it is contemplated that glue (permanent or removable) could be used in place of or to supplement adhesive strip 106.

It is noted that the sample package 110 can be attached to any portion of the length of the publication 202. According to one embodiment, sample package 110 is restricted to the upper quarter of the length of the publication 202. This is especially pertinent when the publication is a periodical (e.g., a magazine) that is often sold in racks or shelving that interfere with the sample packaging 110 of the present invention if the sample packaging 110 were placed too low on the spine of the publication 202.

Figure 3B:
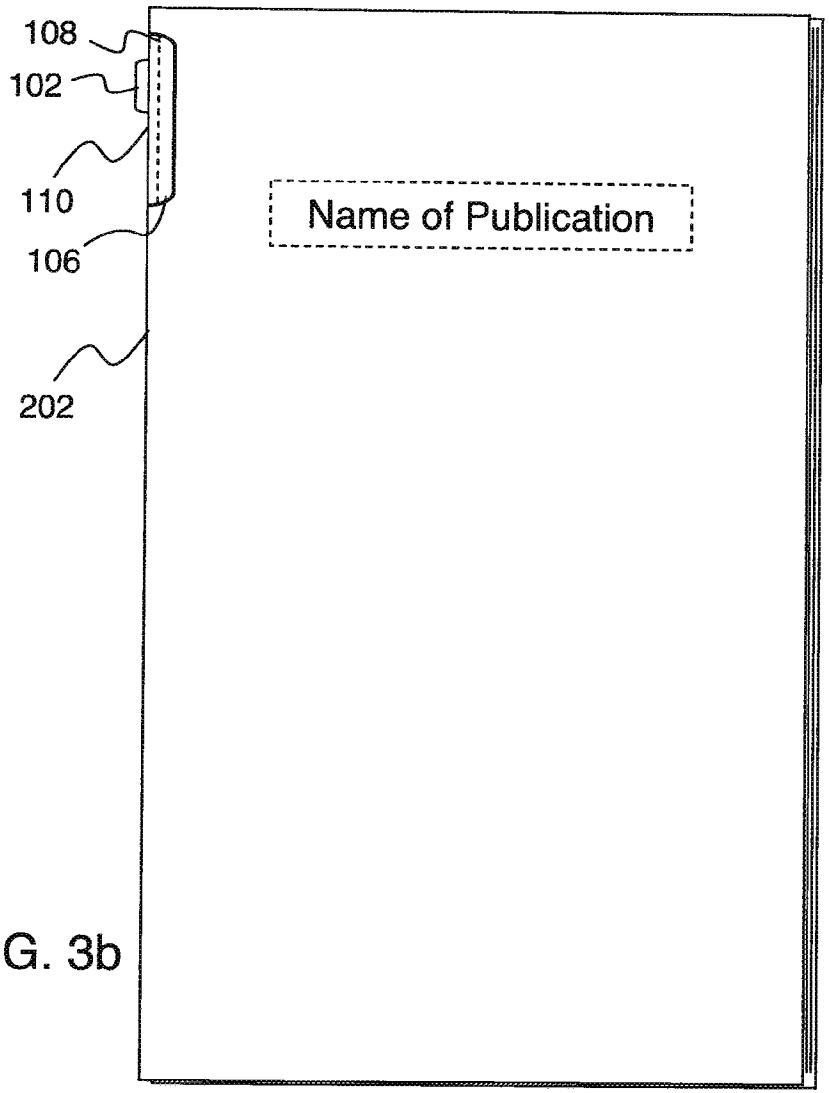
FIGS. 3*a* and 3*b* are illustrations of a sample package attached to a publication.
Figure 3A:
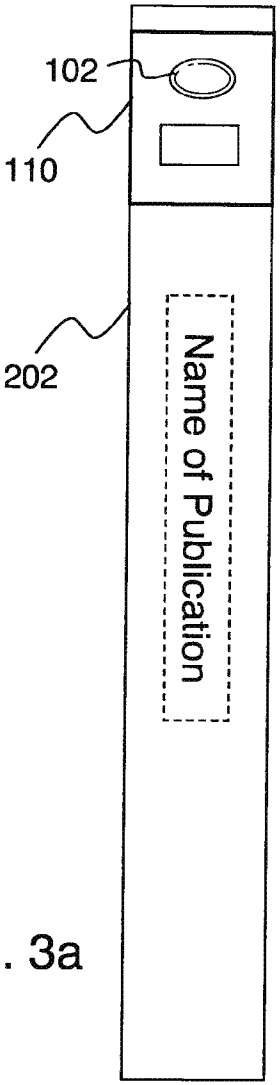

FIGS. 3*a* and 3*b* illustrate an embodiment of the present invention. According to the illustrated embodiment, a sample package 110 is attached to the perfect binding of publication 202 utilizing adhesive strips 106 that having separation lines 108. As shown in FIG. 3*a*, the back of the sample package 110 rests on the spine of the publication 202. In order to prevent the sample package 110 from affecting the stacking of multiple copies of publication 202, it is necessary that the sample package 110 be no wider than the thickness of publication 202. FIG. 3*b* is a profile illustration of the sample package 110 attached to the publication 202.

Figure 4B:
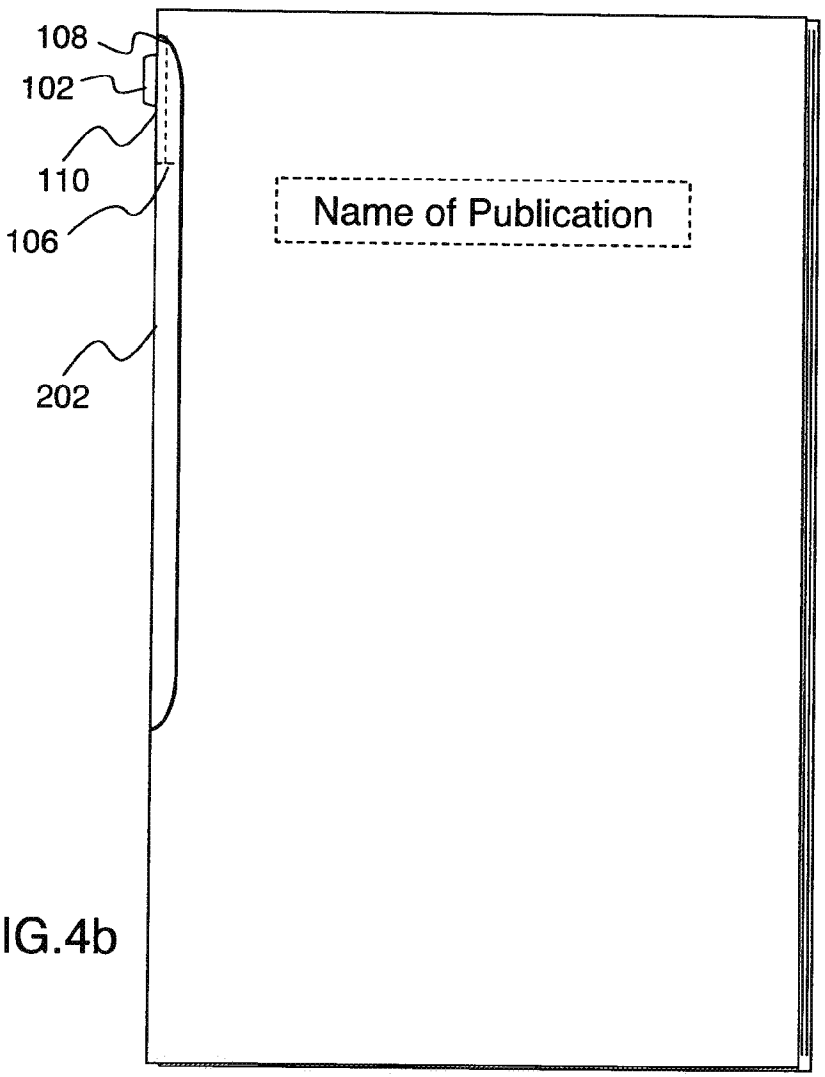
FIGS. 4*a* and 4*b* are illustrations of a sample package attached to a publication.
Figure 4A:
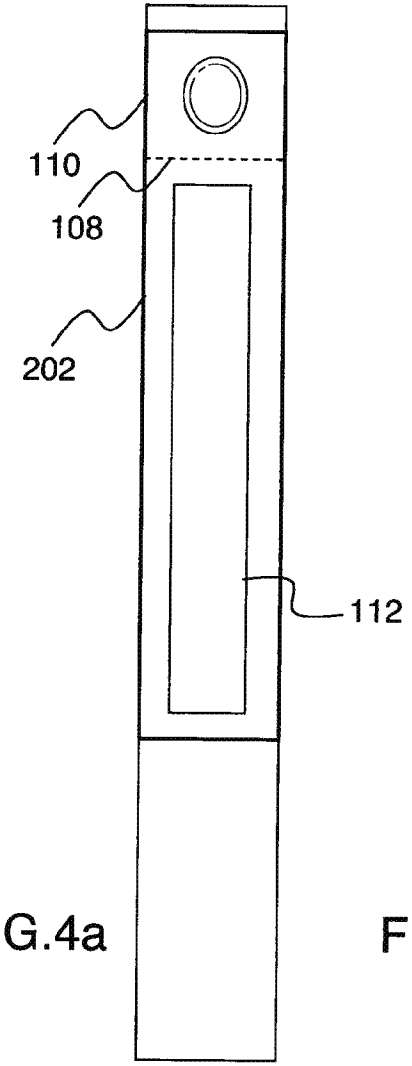

FIGS. 4*a* and 4*b* illustrate an embodiment of the present invention. According to the illustrated embodiment, a sample package 110 is attached to publication 202 utilizing adhesive strips 106 that having separation lines 108. As shown in FIG. 4*a*, the back of the sample package 110 rests on the spine of the publication 202. In this embodiment of the present invention, the sample package 110 extends more than half-way down the spine of the publication 202. It is contemplated that the extended sample package 110 could contain a large individualized content area 112. Additionally, the separation lines shown in FIGS. 4*a* and 4*b*, allow for the removal of the sample portion of the sample package, while allowing the large individualized content area 112 to remain on the publication 202. This has the distinct advantage of advertising to readers of the publication who were likely not the original purchaser of the publication 202. For example, if a magazine with sample package 110 attached were purchased by a doctor's office; it is unlikely that after the first few readers the sample portion of the sample package 110 would be intact. However, according to this embodiment of the present invention, later readers would still have the opportunity to be impacted by the advertising that was related to the sample.

Figures 5A, 5B, 5C:
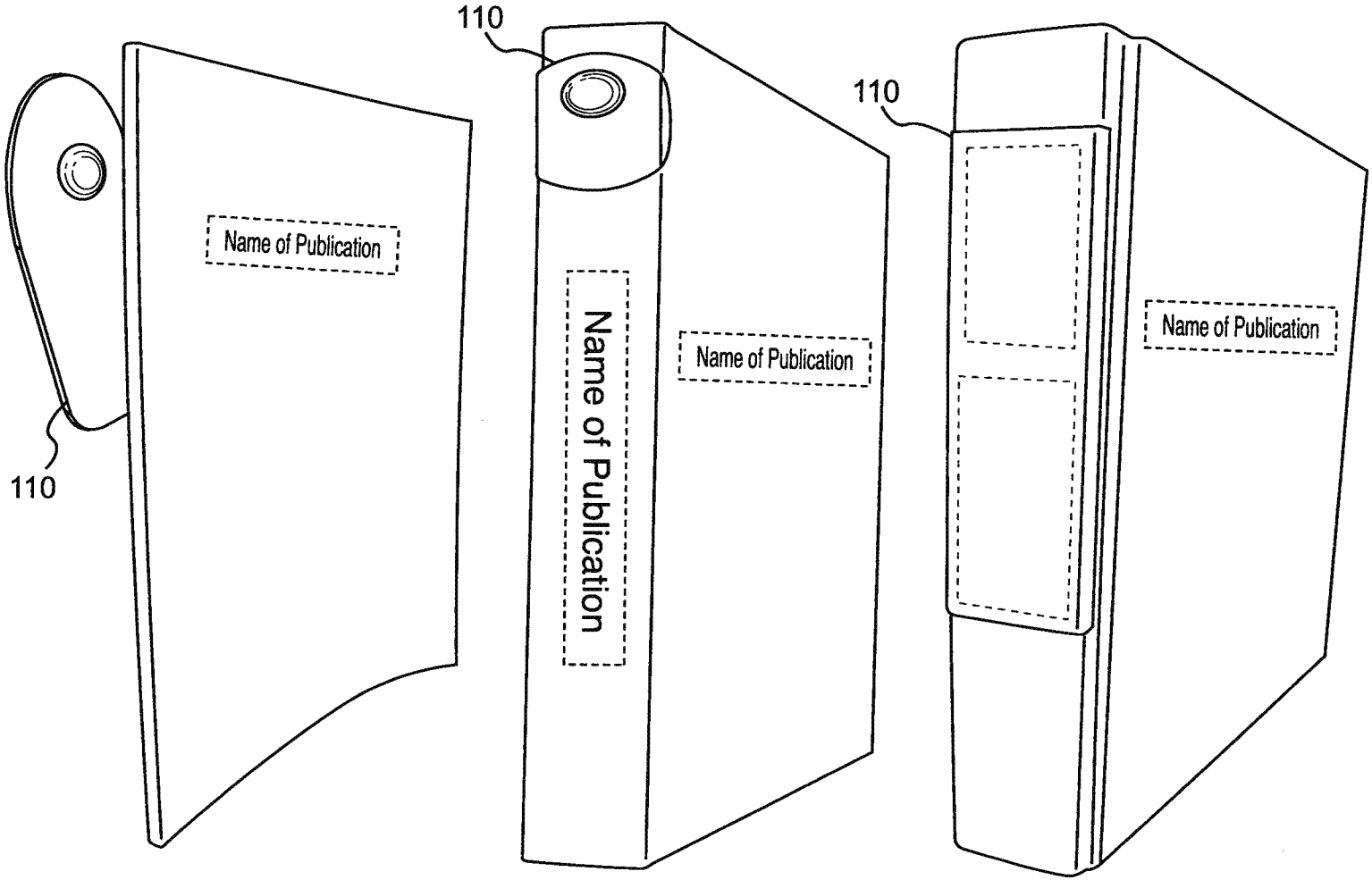
FIGS. 5*a*-5*e* are illustrations of sample packages attached to publications.
Figure 5E:
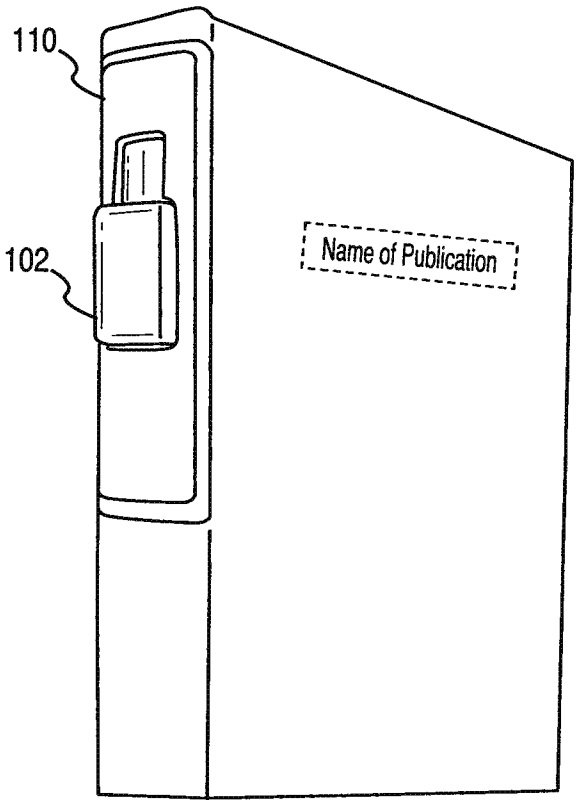
Figure 5D:
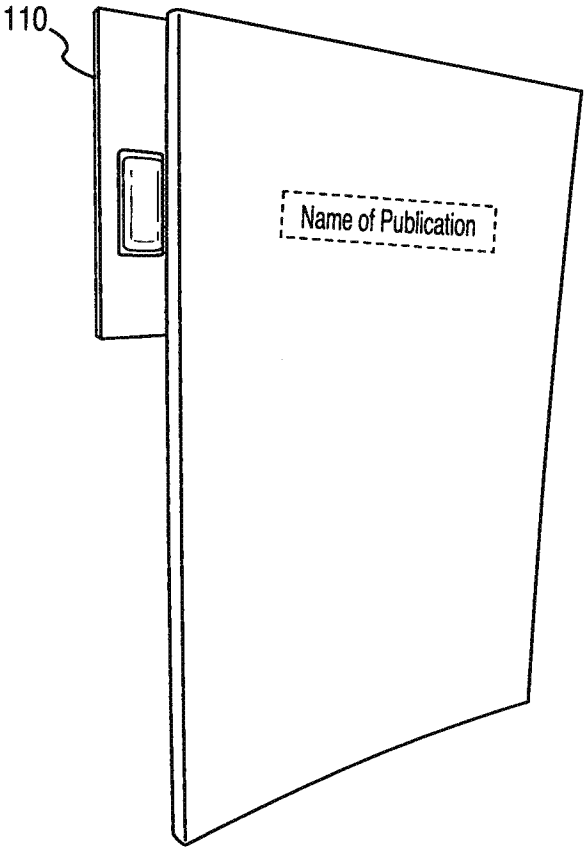

FIGS. 5*a* through 5*e* are illustrations of sample packages 110 attached to publications. In FIGS. 5*a* and 5*b*, the sample packages 110, include liquid blister packages, are attached to magazines. In FIG. 5*a*, the sample package 110 extends from the spine of the publication in a way similar to FIG. 2. In FIG. 5*b*, the sample package 110 abuts the spine of the magazine in a way similar to FIGS. 3*a* and 3*b*. In FIG. 5*c*, a sample package 110, containing a powdered sample, is attached to the spine of a book in a way similar to FIGS. 4*a* and 4*b*. In FIG. 5*d*, a sample package 110, containing a miniature replica of a product, extends from the spine of the publication in a way similar to FIG. 2. In FIG. 5*e*, a sample package 110, containing a sample 102 that is miniature replica of a product, abuts the spine of the magazine in a way similar to FIGS. 3*a* and 3*b*.

Figure 5H:
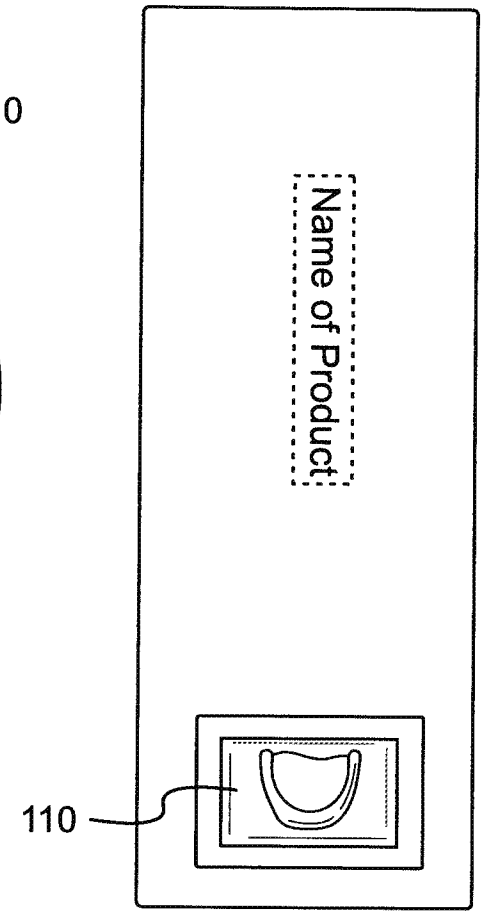
FIGS. 5*f*-5*h* are illustrations of sample packages attached to consumer articles.
Figure 5G:
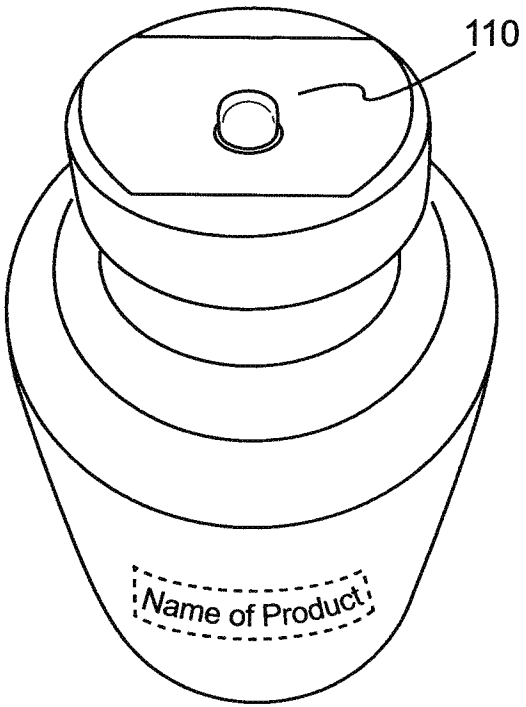
Figure 5F:
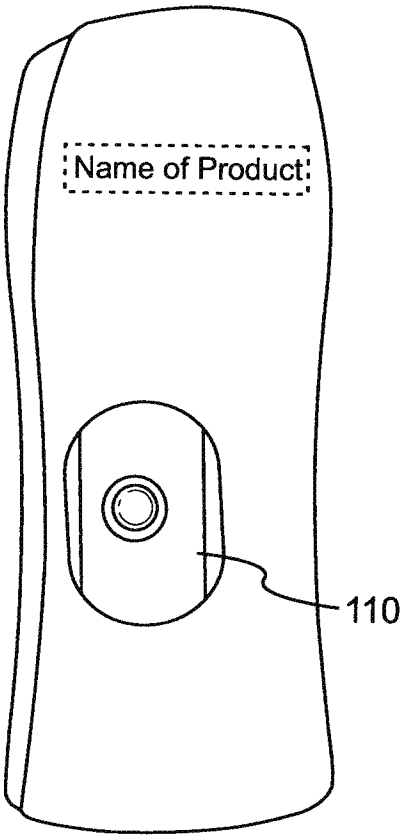

FIGS. 5*f*-5*h* are illustrations of sample packages 110 attached to consumer articles. In FIGS. 5*f*-5*h*, the sample packages 110, include blister packages. In FIG. 5*f*, the blister package is filled with a liquid sample. In FIG. 5*g*, the blister package is filled with a solid sample, such as a pill. In FIG. 5*h*, the sample package 110 contains a sample of a solid consumer product. In this case, the sample product is a flossing device and the consumer article is toothpaste. By packaging a related sample, advertisers can reach their target demographics. It should be noted that sample packages 110 can be applied to consumer articles in any position, i.e., top, side, etc.

Figure 6:
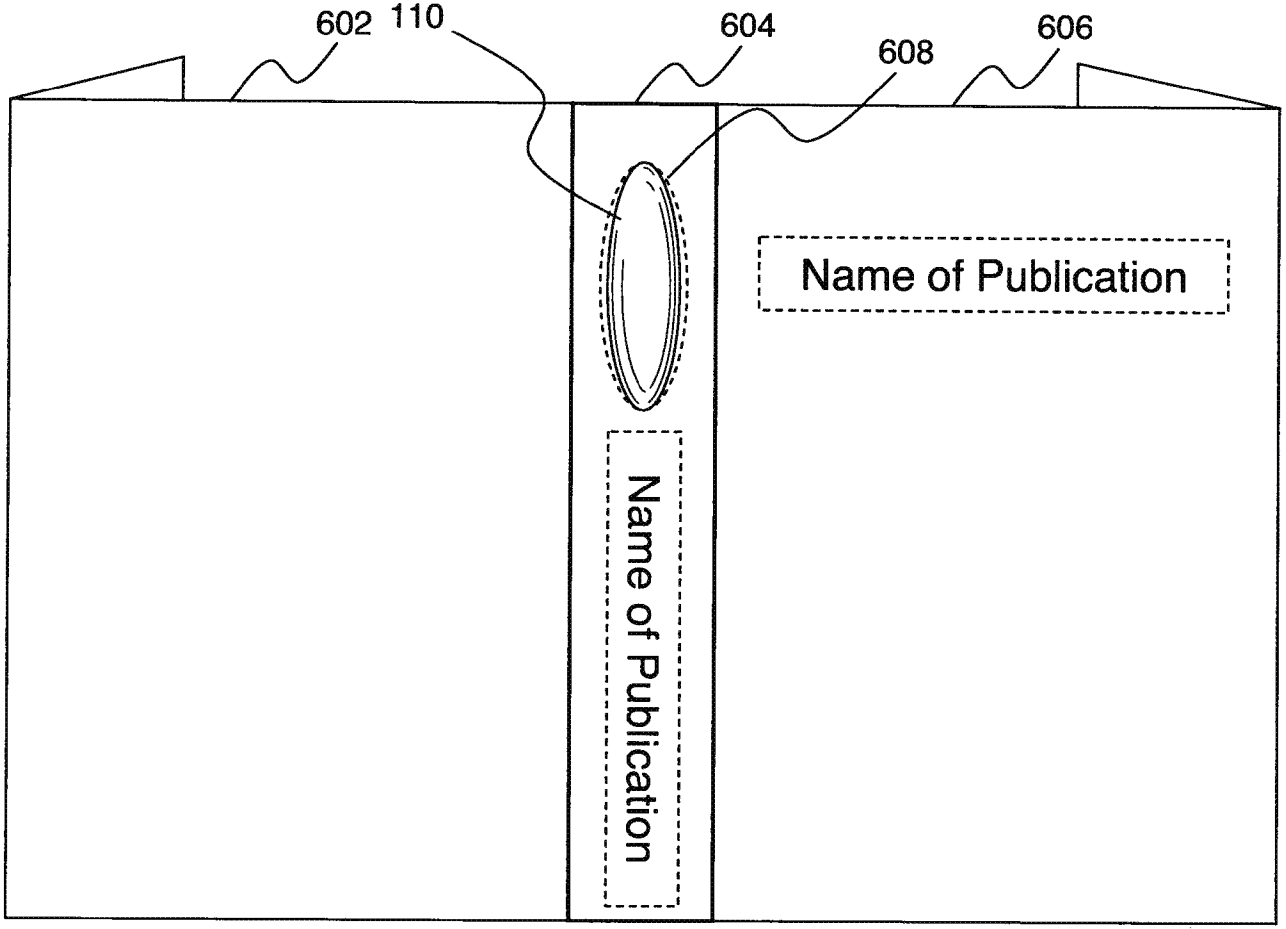
FIG. 6 is an illustration of a sample package attached to a dust jacket.

FIG. 6 is an illustration of a sample package attached to a dust jacket. Specifically, the dust jacket is comprised of three main parts: the front cover 606, the spine cover 604, and the back cover 602. While samples may be attached to dust jackets in a variety of ways, according to the present embodiment the sample package 110 is attached to the spine cover 604 of the dust jacket. According to the illustrated embodiment, an opening 608 is cut or otherwise formed in the spine cover 604. If desired, product copy and/or logo information could then be printed directly on the dust jacket or in the form of a label with a cutout area equivalent to opening 608 and adhered to spine cover 604 relating to the sample product. The sample package 110 is visible and/or protrudes through opening 608. Once the dust jacket is placed on a book, the sample package 110 remains visible and/or accessible without removing the dust jacket from the book. Additionally, sample package 110 may contain product information hidden from view under dust jacket spine cover 604. Illustrations of examples of this type of embodiment of the present invention can be found in FIGS. 7*b* through 7*d*.

Figure 7B:
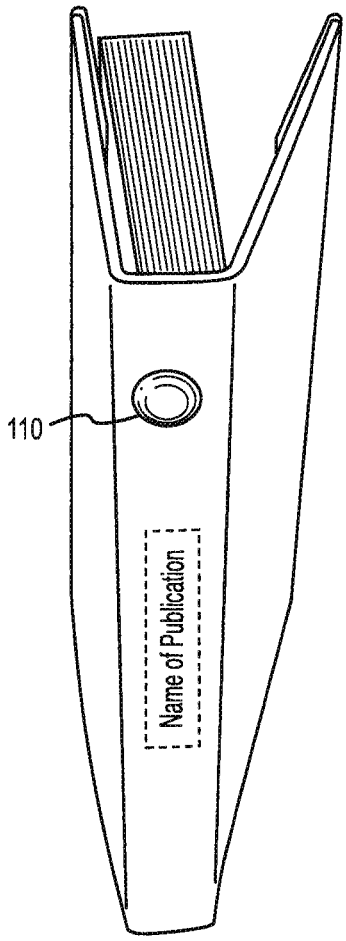
Figure 7D:
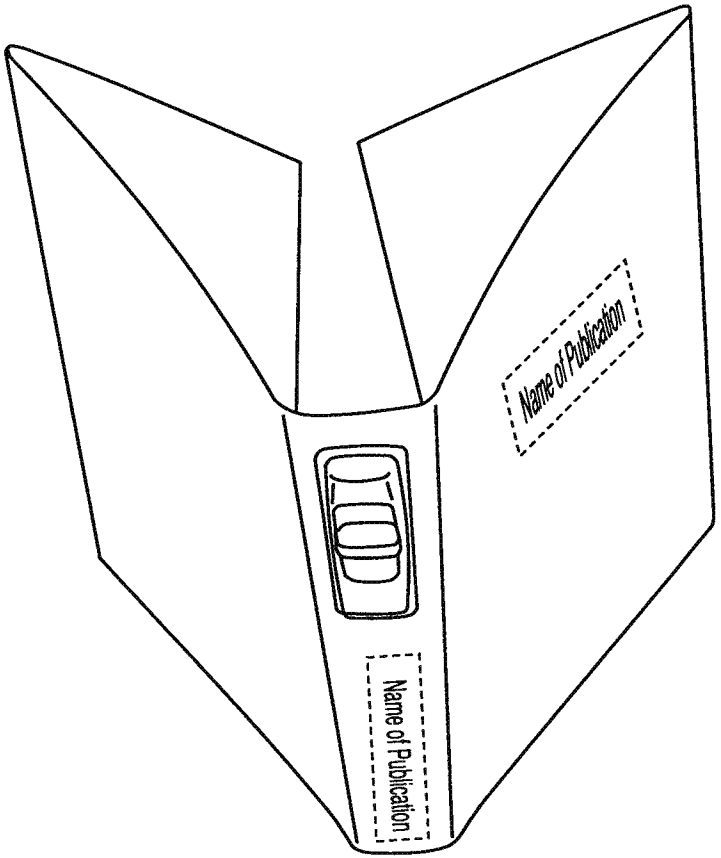
FIG. 7*d* is an illustration of page marking flags attached to a dust jacket.
Figure 7C:
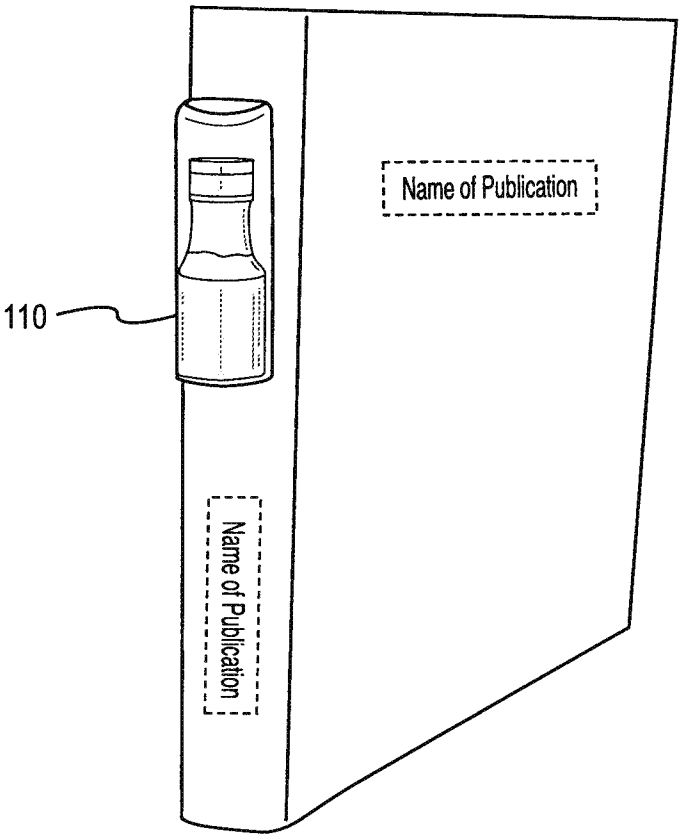

According to one embodiment, FIGS. 7*b* and 7*c* could include a copy area 112 (as shown in FIG. 1*a*) either printed directly on the dust jacket or on a label attached to the dust jacket. According to one embodiment, sample package 110 is placed under the spine cover 604 and copy is printed directly on the spine cover 604. According to another embodiment, the sample package 110 is placed on top of the spine cover 604, thus obviating the need for a dust jacket to have opening 608. According to this embodiment, the copy area 112 is found on the sample package 110 or in a booklet/extended content label (similar to that shown in FIGS. 1*b*-1*d*).

Additionally, according to another embodiment of the present invention, as shown in FIG. 7*a*, the sample package 110 is attached to the spine cover 604 in a way similar to that shown in 3*a* and 3*b*.

Figure 8B:
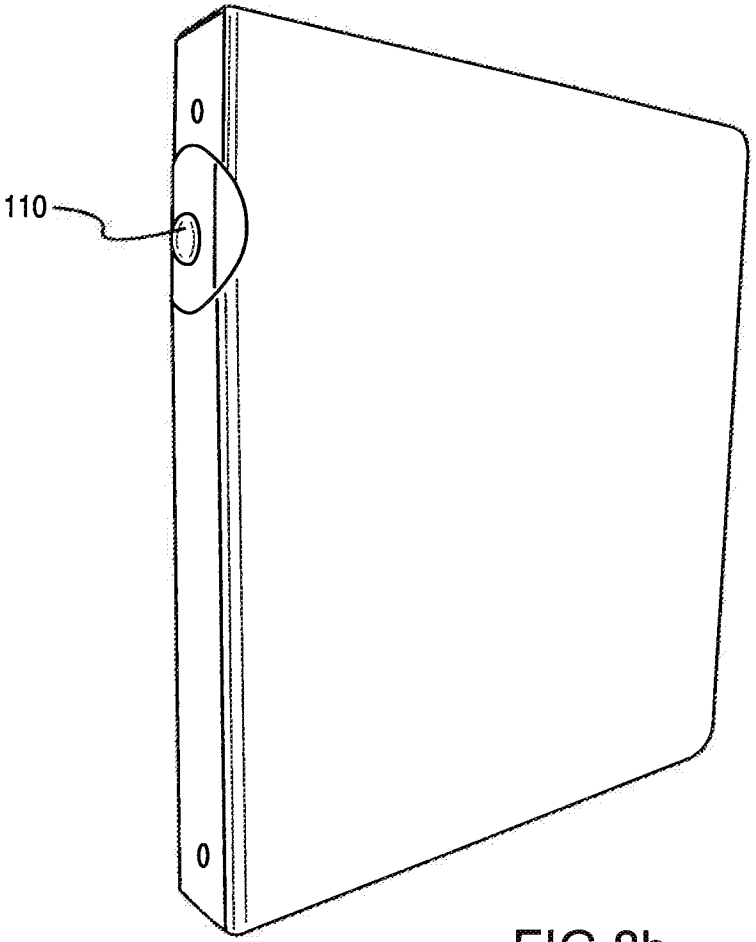
FIG. 8*b* is an illustration of a sample package attached to a three ring binder.
Figure 8A:
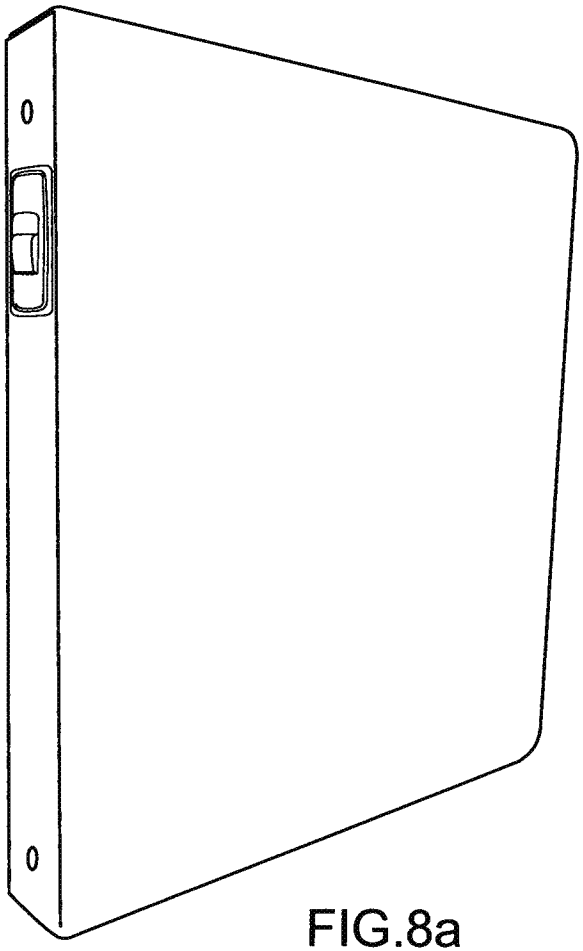
FIG. 8*a* is an illustration of page marking flags attached to a three ring binder.

FIGS. 7*d* and 8*a* illustrate embodiments of the present invention related to attaching page markers to publications and/or commercial articles, such as, but not limited to: publications, writing utensil cases, crayon and/or marker boxes, paper organizers, folders, etc. FIG. 7*d* is an illustration of page markers that are both visible and available through the dust jacket of a publication. FIG. 8*a* is an illustration of a page flag dispenser attached to the spine of a three ring binder. According to various embodiments of the present invention a page flag dispenser could reside directly on a publication binding spine, on top of a dust jacket as shown in 7*d*, on the binding spine of a publication area 604 with a dust jacket cutout area 608 through which the page flag dispenser protrudes similar to that shown in FIG. 6.

FIG. 8*b* is an illustration of a sample package 110 attached to a three ring binger.

The invention being thus described, it will be apparent to those skilled in the art that the same may be varied in many ways without departing from the spirit and scope of the invention. Any and all such modifications are intended to be included within the scope of the following claims.

What is claimed is:

1. An apparatus for distributing product samples, comprising:

a sample package, wherein said sample package comprises a flat sample backing and a sample product attached to the sample backing; and a publication having a front cover and a back cover, wherein said sample backing is attached to only one of the front and back covers of said publication, a flat surface of the sample backing flatly abuts the one of the front and back covers of said publication, the sample backing extends from the one of the front and back covers in a plane that is parallel to the plane of the one of the front and back covers, and said sample product is external to the publication.

2. The apparatus of claim 1, wherein the sample product is at least one of a solid or liquid product contained within a blister package.

3. The apparatus of claim 1, wherein the sample product is a liquid product contained within at least one of a vial, tube, aerosol dispenser, foil package, or sachet.

4. The apparatus of claim 1, wherein the sample product is a solid.

5. The apparatus of claim 1, wherein the sample product is a liquid.

6. The apparatus of claim 1, wherein the sample product and the sample backing are joined using at least one of adhesive tape, staples, or glue.

7. The apparatus of claim 1, wherein the sample product and the sample backing are joined through friction by sandwich folding of paper, plastic or metal.

8. The apparatus of claim 1, wherein the sample product and the sample backing are joined using plastic skin packaging.

9. The apparatus of claim 1, wherein the sample package further comprises at least one of a paper or plastic pouch.

10. The apparatus of claim 1, wherein said sample package is removably attached to said publication.

11. The apparatus of claim 1, wherein said sample package is permanently attached to said publication.

12. The apparatus of claim 1, wherein, when said sample package is removed from said publication, a portion of the sample backing remains on the publication.

13. The apparatus of claim 1, wherein said sample package includes an instantly redeemable coupon.

14. The apparatus of claim 1, wherein a thickness of said sample package is equal to or less than a thickness of the publication.

15. The apparatus of claim 1, wherein the sample product is a miniature version of a full-size product.

16. The apparatus of claim 1, wherein said sample package is attached to said publication in a way that, when the apparatus is stacked with other apparatuses, the sample product does not create a bulge.

17. The apparatus of claim 1, wherein the sample package extends from a spine of the publication.

18. The apparatus of claim 1, wherein the sample product is outside the perimeter of the cover to which the sample package is attached.

19. The apparatus of claim 1, wherein the sample backing is attached to a binding spine of the publication and to only one of the front and back covers of said publication.

* * * * *